US007322417B2

(12) United States Patent
Rytlewski et al.

(10) Patent No.: US 7,322,417 B2
(45) Date of Patent: Jan. 29, 2008

(54) TECHNIQUE AND APPARATUS FOR COMPLETING MULTIPLE ZONES

(75) Inventors: Gary L. Rytlewski, League City, TX (US); Ashish Sharma, Pearland, TX (US); Liana M. Mitrea, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 288 days.

(21) Appl. No.: 11/081,005

(22) Filed: Mar. 15, 2005

(65) Prior Publication Data

US 2006/0124312 A1 Jun. 15, 2006

Related U.S. Application Data

(63) Continuation-in-part of application No. 10/905,073, filed on Dec. 14, 2004.

(51) Int. Cl.
*E21B 34/14* (2006.01)

(52) U.S. Cl. ..... 166/313; 166/386; 166/318

(58) Field of Classification Search ..... 166/308.1, 166/386, 177.5, 313, 318, 319, 320, 321, 166/329
See application file for complete search history.

(56) References Cited

U.S. PATENT DOCUMENTS 3,011,548 A * 12/1961 Holt ..... 166/284
3,054,415 A * 9/1962 Baker et al. ..... 137/68.16
3,269,463 A * 8/1966 Page, Jr. ..... 166/329
3,995,692 A 12/1976 Seitz
4,064,937 A * 12/1977 Barrington ..... 166/162
4,355,686 A 10/1982 Arendt et al.
4,729,432 A 3/1988 Helms
5,183,114 A * 2/1993 Mashaw et al. ..... 166/319
5,224,044 A 6/1993 Tamura
5,921,318 A * 7/1999 Ross ..... 166/250.17
5,988,285 A * 11/1999 Tucker et al. ..... 166/373
6,059,032 A * 5/2000 Jones ..... 166/278
6,155,342 A 12/2000 Oneal (Continued)

FOREIGN PATENT DOCUMENTS

WO 03/095794 A1 11/2003

(Continued)

OTHER PUBLICATIONS

Thomson, D.W. and Nazroo, M.F.; "Design and Installation of a Cost-Effective Completion System for Horizontal Chalk Wells Where Multiple Zones Require Acid Stimulation"; Offshore Technology Conference, May 1997, Houston, Texas; SPE 51177 (a revision of SPE 39150).

*Primary Examiner*—David Bagnell
*Assistant Examiner*—David Andrews
(74) *Attorney, Agent, or Firm*—Fred G. Pruner; Dona C. Edwards; Bryan P. Galloway

(57) ABSTRACT

An apparatus that is usable with a well includes a string and a plurality of tools that are mounted in the string. The string includes a passageway. The tools are mounted in the string and are adapted to be placed in a state to catch objects (free-falling objects and/or pumped-down objects, as just a few examples) of substantially the same size, which are communicated downhole through the passageway.

40 Claims, 9 Drawing Sheets

U.S. PATENT DOCUMENTS

| | | | | |
|---|---|---|---|---|
| 6,216,785 | B1 | 4/2001 | Achee, Jr. et al. | |
| 6,334,486 | B1 | 1/2002 | Carmody | |
| 6,634,429 | B2 * | 10/2003 | Henderson et al. | 166/332.1 |
| 6,997,263 | B2 * | 2/2006 | Campbell et al. | 166/374 |
| 2003/0019634 | A1 * | 1/2003 | Henderson et al. | 166/373 |
| 2004/0020652 | A1 * | 2/2004 | Campbell et al. | 166/313 |
| 2004/0118564 | A1 * | 6/2004 | Themig et al. | 166/305.1 |
| 2006/0124310 | A1 * | 6/2006 | Lopez de Cardenas et al. | 166/313 |
| 2006/0207764 | A1 * | 9/2006 | Rytlewski | 166/313 |
| 2006/0243455 | A1 * | 11/2006 | Telfer et al. | 166/386 |

FOREIGN PATENT DOCUMENTS

WO WO2004/088091 A1 * 10/2004

* cited by examiner

TECHNIQUE AND APPARATUS FOR COMPLETING MULTIPLE ZONES

This application is a continuation-in-part of U.S. patent application Ser. No. 10/905,073 entitled, "SYSTEM FOR COMPLETING MUTLIPLE WELL INTERVALS," filed on Dec. 14, 2004, which is hereby incorporated by reference in its entirety.

BACKGROUND

The present invention generally relates to a technique and apparatus to complete multiple zones.

For purposes of enhancing production from a subterranean well, the layers of the well may be fractured using a pressurized proppant-containing fracturing fluid or other treating fluids such as acid. The layers typically are fractured one at time by directing fracturing fluid to the layer being fractured and isolating the other layers.

A conventional fracturing system includes surface pumps that pressurize fracturing fluid, which may be communicated downhole via the central passageway of a tubular string. The string extends downhole through a wellbore that traverses the various layers to be fractured; and the string may include valves (sleeve valves, for example) that are generally aligned with the layers so that the valves may be used to control fluid communication between the central passageway of the string and the layers. Thus, when a fracturing operation is performed on one of the layers, one of the valves is opened so that fracturing fluid may be communicated through the opened valve to the associated layer.

To remotely operate the valves from the surface of the well, the valves may contain many different size ball seats. More specifically, to target and actuate the valves, differently sized balls may be dropped into the central passageway of the string from the surface of the well. Each ball size may be uniquely associated with a different valve, so that a particular ball size is used to actuate a specific valve. The smallest ball opens the deepest valve. More particularly, a free-falling ball lodges, or is "caught" by, a ball seat of the targeted valve. To discriminate between the different valves, each ball seat of the string has a different diameter.

After a ball lodges in a ball seat, fluid flow through the central passageway of the string becomes restricted, a condition that allows fluid pressure to be applied from the surface of the well for purposes of exerting a downward force on the ball. The ball seat typically is attached to a sleeve of the valve to transfer the force to the sleeve to cause the valve to open.

The annular area that is consumed by each ball seat restricts the cross-sectional flow area through the string (even in the absence of a ball), and the addition of each valve (and ball seat) to the string further restricts the cross-sectional flow area through the central passageway of the string, as the flow through each ball seat becomes progressively more narrow as the number of ball seats increase. Thus, a large number of valves may significantly restrict the cross-sectional flow area through the string.

As an alternative to the ball seat being located in the string as part of the valves, a single activation tool may be selectively positioned in side the central passageway of the string to operate the valves. More specifically, a valve actuation tool may be lowered downhole by a conveyance mechanism (a slickline, for example) to the valve to be opened and to close previously-opened valves.

A challenge with this alternative is that the fracturing pumps at the surface of the well may need to be idled after each layer is fractured. Furthermore, each valve typically is closed after its associated fracturing operation. The reclosure of the valves demands that the seals and sealing surfaces withstand the fracturing operations without damage.

Thus, there is a continuing need for a technique and/or arrangement to address one or more of the problems that are set forth above as well as possibly address one or more problems that are not set forth above.

SUMMARY

In an embodiment of the invention, an apparatus that is usable with a well includes a string and a plurality of tools that are mounted in the string. The string includes a passageway. The tools are mounted in the string and are adapted to be placed in a state to catch objects (free-falling objects and/or pumped-down objects, as just a few examples) of substantially the same size, which are communicated downhole through the passageway.

In another embodiment of the invention, an apparatus that is usable with a well includes a tubular member, a first tool and a second tool. The tubular member includes a passageway. The first tool is attached to the tubular member, and the first tool is adapted to be placed in a state to catch a first object that is communicated through the passageway and perform an operation after catching the first object. The second tool is attached to the tubular member and is adapted to transition to a state to catch a second object communicated through the passageway in response to the operation.

In yet another embodiment of the invention, a technique that is usable with a well includes providing a string that has a plurality of tools and a passageway that extends through the tools. The technique includes without running an activation tool into the passageway; and selectively activating the tools of the string to cause each activated tool to transition from a first state in which the activated tool is configured to allow a free-falling object to pass through the passageway to a second state in which the activated tool is configured to catch the free-falling object.

Advantages and other features of the invention will become apparent from the following description, drawing and claims.

DETAILED DESCRIPTION

Figure 1:
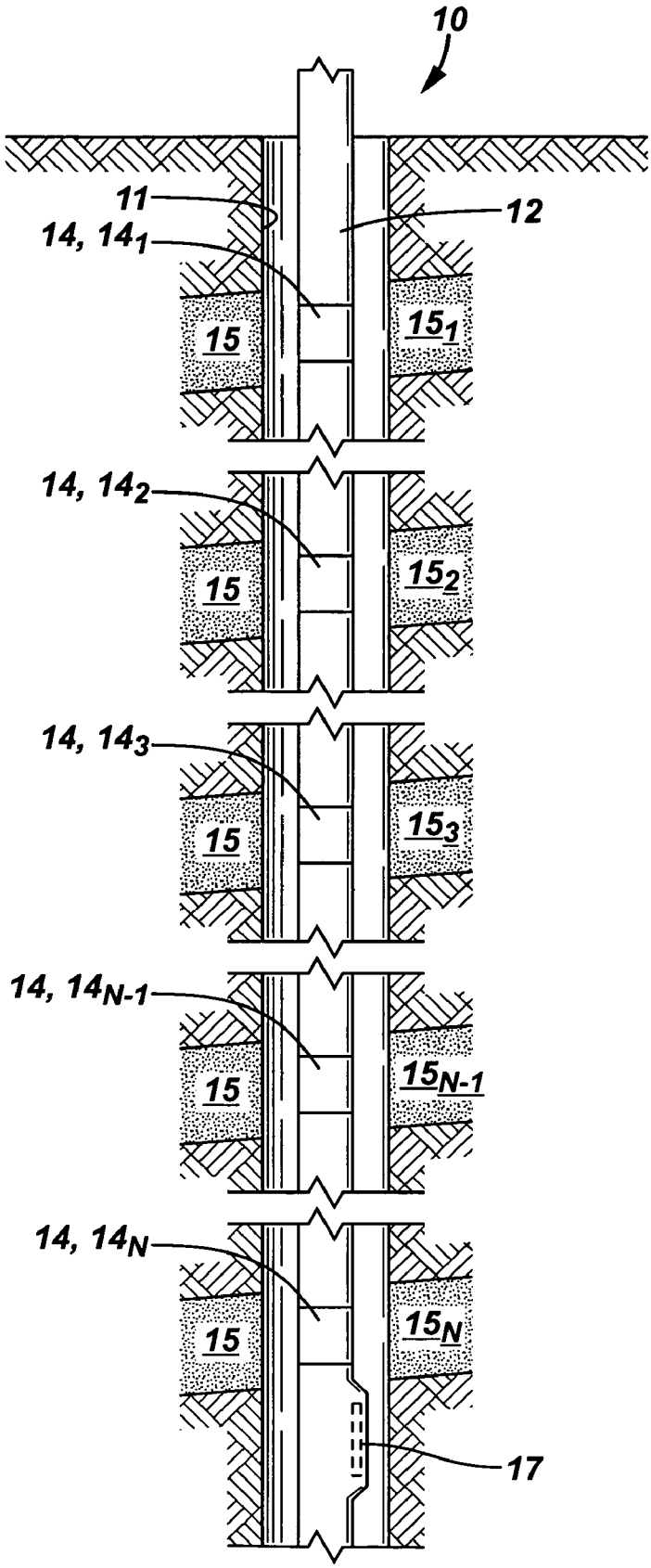
FIG. 1 depicts a fracturing system according to an embodiment of the invention.

Referring to FIG. 1, an embodiment 10 of a fracturing system includes a string 12 that extends into a wellbore 11 that traverses N layers 15 (layers $\mathbf{15}_1$, $\mathbf{15}_2$, $\mathbf{15}_3 \ldots \mathbf{15}_{N-1}$ and $\mathbf{15}_N$, depicted as examples) of the well. As depicted in FIG. 1, the string 12 includes valves 14 (valves $\mathbf{14}_1$, $\mathbf{14}_2$, $\mathbf{14}_3 \ldots \mathbf{14}_{N-1}$ and $\mathbf{14}_N$, depicted as examples), each of which is associated with a particular layer 15. For example, the valve $\mathbf{14}_3$ is associated with the layer $\mathbf{15}_3$. Thus, to fracture a particular layer 15, the associated valve 14 (initially run downhole in a closed state) is opened by dropping a ball and pumping up, which shifts the sleeve valve open (as described below) to allow communication between the central passageway of the string 12 and the associated layer 15. This communication, in turn, permits fracturing fluid and pressure to be routed to the associated layer 15.

More specifically, in some embodiments of the invention, each valve 14 controls communication between a central passageway of the string 12 and an annular region that surrounds the valve 14. When the string 12 is run downhole, all of the valves 14 are initially closed. However, the valves 14 are successively opened one at a time in a predetermined sequence (described below) for purposes of fracturing the layers 15.

As a more specific example, in some embodiments of the invention, the valves are opened in a sequence that begins at the bottom of the string 12 with the lowest valve $\mathbf{14}_N$, proceeds uphole to the next immediately adjacent valve 14, then to the next immediately adjacent valve 14, etc. Thus, the valve $\mathbf{14}_N$ is opened before the valve $\mathbf{14}_{N-1}$, the valve $\mathbf{14}_3$, is opened before the valve $\mathbf{14}_2$, etc.

For purposes of opening a particular valve 14, a free-falling or pumped-down object is deployed from the surface of the well into the central passageway of the string 12. It is assumed below for purposes of clarifying the following discussion that the object is a spherical ball. However, it is understood that in other embodiments of the invention, other object types and/or differently-shaped objects may be used.

In some embodiments of the invention, a ball of the same dimension may be used (although different size balls may be used in other embodiments of the invention) to open all of the valves 14, as only one of the previously-unopened valves (called the "targeted valve" herein) is in a "ball catching state" at any one time. More specifically, in accordance with some embodiments of the invention, all of the balls that are pumped or dropped downhole for purposes of opening one of the valves 14 may have diameters that vary less than approximately 0.125 inches from each other.

As described below, initially, all of the valves 14 are closed, and none of the valves 14 are in ball catching states. When a particular valve 14 opens, the valve 14 places the next valve 14 in the sequence in the ball catching state. When in the ball catching state, the valve 14 forms a seat that presents a restricted cross-sectional flow passageway to catch a ball that is dropped into the central passageway of the string 12. For the sequence that is described above, the unopened valves 14 that are located above the unopened valve 14 that is in the ball catching state allow the ball to pass through.

After the ball lodges in the ball catcher of the targeted valve 14, the ball significantly restricts, if not seals off, the central passageway of the string 12 below the ball so that fluid pressure may be applied above the ball to generate a force to cause the valve to open, as further described below.

As a more specific example, a ball may be dropped from the well's surface into the central passageway of the string 12 for purposes of opening a previously-unopened valve $\mathbf{14}_N$ that has previously been placed in a ball catching state. In response to the fluid pressure that is applied to the resultant restricted central passageway, the valve $\mathbf{14}_N$ opens to allow a fracturing operation to be performed on the associated layer $\mathbf{15}_N$. The opening of the valve $\mathbf{14}_N$, in turn, places the next valve $\mathbf{14}_{N-1}$ in the sequence in the ball catching state. Once the fracturing operation on the layer $\mathbf{15}_N$ is complete, another ball is dropped into the central passageway of the string 12 for purposes of opening the valve $\mathbf{14}_{N-1}$ so that the layer $\mathbf{15}_{N-1}$ can be fractured. Thus, this sequence continues until the last valve $\mathbf{14}_1$ is opened, and the associated layer $\mathbf{15}_1$ is fractured.

Figure 2:
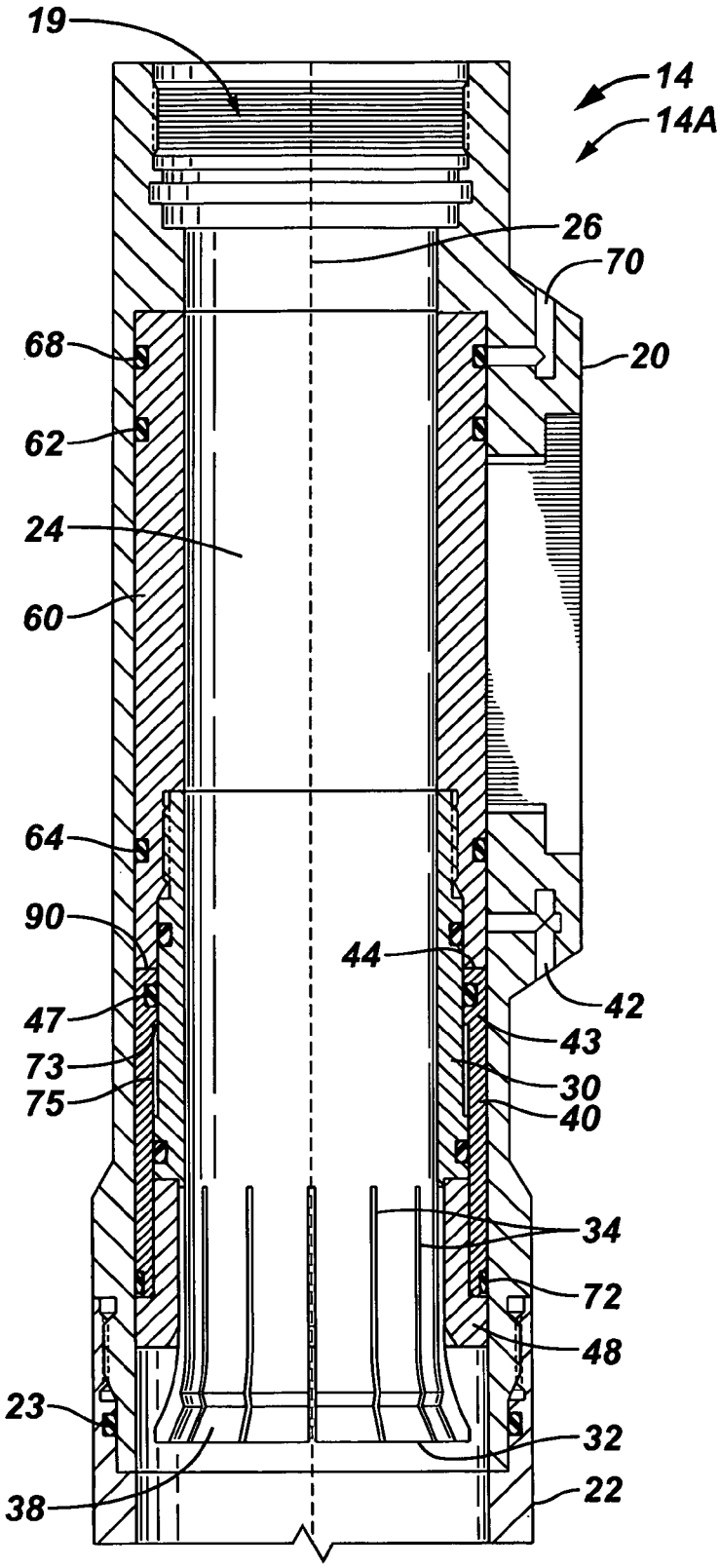
FIGS. 2 and 3 depict a valve in a closed state and before being placed in a ball catching state according to an embodiment of the invention.
Figure 3:
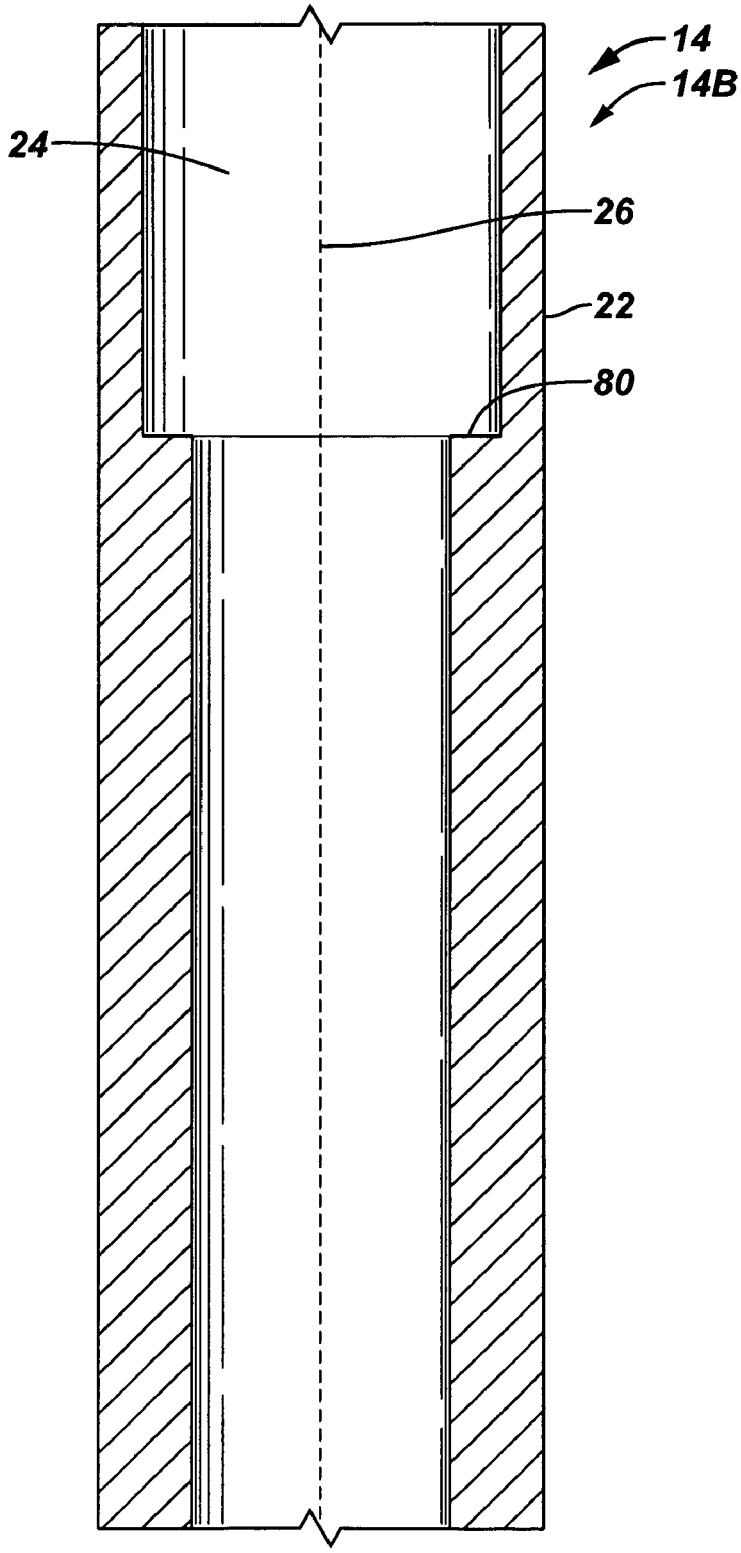

As a more specific example, in accordance with some embodiments of the invention, FIGS. 2 and 3 depict upper 14A and lower 14B sections of an exemplary valve 14 that is closed and has not been placed in ball catching state (i.e., the valve 14 is in its initial states when run into the well). Thus, as depicted in FIGS. 2 and 3, the valve 14 does not restrict its central passageway 24. As further described below, the valve 14 may be subsequently placed in the ball catching state, a state in which the valve 14 compresses a collet sleeve 30 to form an annular seat to catch the ball.

Turning now to the specific details of the embodiment that is depicted in FIGS. 2 and 3, in some embodiments of the invention, the valve 14 includes a generally cylindrical upper housing section 20 (FIG. 2) that is coaxial with a longitudinal axis 26 of the valve 14. The upper housing section 20 includes an opening 19 to communicate fluids (well fluid, fracturing fluid, etc.) with the portion of the string 12 that is located above and is attached to the upper housing section 20. At its lower end, the upper housing section 20 is coaxial with and is connected to a generally cylindrical lower housing section 22 (FIGS. 2 and 3). As depicted in FIG. 2, in some embodiments of the invention, a seal such as an O-ring 23 may be present between the upper 20 and lower 22 housing sections.

The valve 14 includes a valve sleeve 60 (FIG. 2) that is coaxial with the longitudinal axis 26 and is constructed to move longitudinally within an annular pocket 80 (see FIG. 3) that is formed in the upper 20 and lower 22 housing sections of the valve 14. The central passageway of the valve sleeve 60 forms part of the central passageway 24 of the valve 14. Upper 62 and lower 64 O-rings circumscribe the outer surface of the sleeve 60 and form corresponding annular seals between the outer surface of the sleeve 60 and the inner surface of the housing section 20 for purposes of sealing off radial openings (not shown in FIG. 2) in the upper housing section 20 during the closed state (depicted in FIGS. 2 and 3) of the valve 14. As further described below, when the sleeve 60 moves in a downward direction to open the valve 14, openings in the upper housing section 20 are exposed to place the valve 14 in an open state, a state in which fluid communication occurs between the central passageway 24 of the valve 14 and the region that surrounds the valve 14.

At its lower end, the valve sleeve 60 is connected to the upper end of the collet sleeve 30, a sleeve whose state of radial expansion/contraction controls when the valve 14 is in the ball catching state. The collet sleeve 30 is generally coaxial with the longitudinal axis 26. In some embodiments of the invention, the collet sleeve 30 includes a lower end 32 in which longitudinal slots 34 are formed, and these slots 34 may be regularly spaced about the longitudinal axis 26 of the collect sleeve 30.

In its expanded state (depicted in FIG. 2), the lower end 32 of the collet sleeve 30 is flared radially outwardly for purposes of creating the maximum diameter through the interior of the collet sleeve 30. Thus, as depicted in FIG. 2, in this state of the collet sleeve 30, an opening 38 in the lower end 32 of the sleeve 30 has its maximum inner diameter, thereby leaving the central passageway 24 unobstructed.

For purposes of radially compressing the lower end 32 of the collet sleeve 30 to place the valve 14 in its ball catching state, the valve 14 includes a mandrel 40. The mandrel 40 is designed to slide in a downward longitudinal direction (from the position depicted in FIG. 2) for purposes of sliding a sleeve 48 over the lower end 32 to radially compress the lower end 32. The mandrel 40 is depicted in FIG. 2 in a position to allow full radial expansion of the lower end 32 of the collet sleeve 30, and thus, in this position, the mandrel 40 does not configure the collet sleeve 30 to catch a ball.

For purposes of actuating the mandrel 40 to move the mandrel 40 in a downward direction, the mandrel 40 includes a piston head 43 that has an upper surface 44. The upper surface 44, in turn, is in communication with a fluid passageway 42 that may be formed in, for example, the upper housing section 20. The upper surface 44 of the piston head 43 is exposed to an upper chamber 90 (having its minimum volume in FIG. 2) of the valve 14 for the purpose of creating a downward force on the mandrel 40 to compress the lower end 32 of the collet sleeve 30.

As depicted in FIG. 2, an O-ring 47 forms a seal between the inner surface of the piston head 43 and the outer surface of the collet sleeve 30; and a lower O-ring 72 is located on the outside of the mandrel 40 for purposes of forming a seal between the exterior surface of the mandrel 40 and the interior surface of the upper housing section 20. Due to these seals, the upper chamber 90 is sealed off from a lower chamber 75, a chamber that is below a lower surface 73 of the piston head 43. As an example, in some embodiments of the invention, the lower chamber 75 has gas such as air at atmospheric pressure or other low pressure or at a vacuum.

The lower end of the mandrel 40 is connected to the sleeve 48 that has an inner diameter that is sized to approximately match the outer diameter of the section of the collet sleeve 30 located above the flared lower end 32. Thus, when the pressure that is exerted on the upper surface 47 of the piston head 43 creates a force that exceeds the combined upward force exerted from the chamber 75 to the lower surface 73 and the reaction force that is exerted due to the compression of the lower end 32, the sleeve 48 restricts the inner diameter of the lower end 32 of the collet sleeve 30 to place the valve 14 in its ball catching state.

Figure 4:
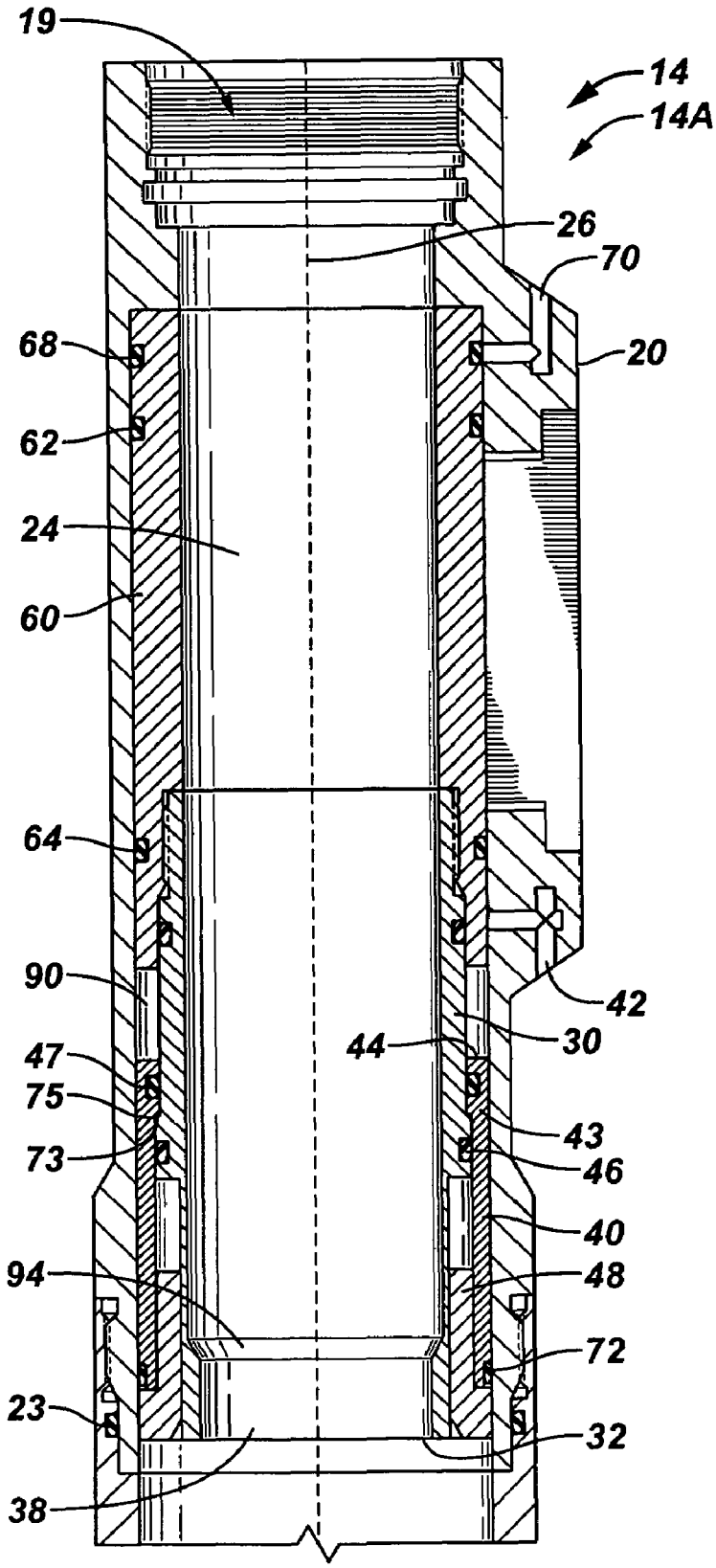
FIG. 4 depicts the valve in a closed state and after being placed in a ball catching state according to an embodiment of the invention.

FIG. 4 depicts the upper section 14A of the valve 14 when the valve 14 is in the ball catching state, a state in which the mandrel 40 is at its lowest point of travel. In this state, the valve sleeve 60 remains in its uppermost point of travel to keep the valve 14 closed. As shown, in this position, the outer diameter of the lower end 32 of the collet sleeve 40 is confined by the inner diameter of the sleeve 48, and an interior annular seat 94 is formed inside the collet sleeve 30. The seat 94, in turn, presents a restricted inner diameter for catching a ball.

The capture of the ball on the seat 94 substantially restricts, if not seals off, the central passageway of the valve 14 above the ball from the central passageway of the valve 14 below the ball. Due to this restriction of flow, pressure may be applied from the surface of the well for purposes of exerting a downward force on the collet sleeve 30. Because the upper end of the collet sleeve 30 is connected to the lower end of the valve sleeve 60, when pressure is applied to the lodged ball and collet sleeve 30, a corresponding downward force is generated on the valve sleeve 60. The sleeve 60 may be initially retained in the upward position that is depicted in FIGS. 2 and 4 by such mechanism(s) (not depicted in the figures) as one or more detent(s), one or more shear pins, trapped low pressure, or vacuum chamber(s). However, when a sufficient downward force is applied to the valve sleeve 60, this retention mechanism gives way to permit downward movement of the valve sleeve 60.

Figure 5:
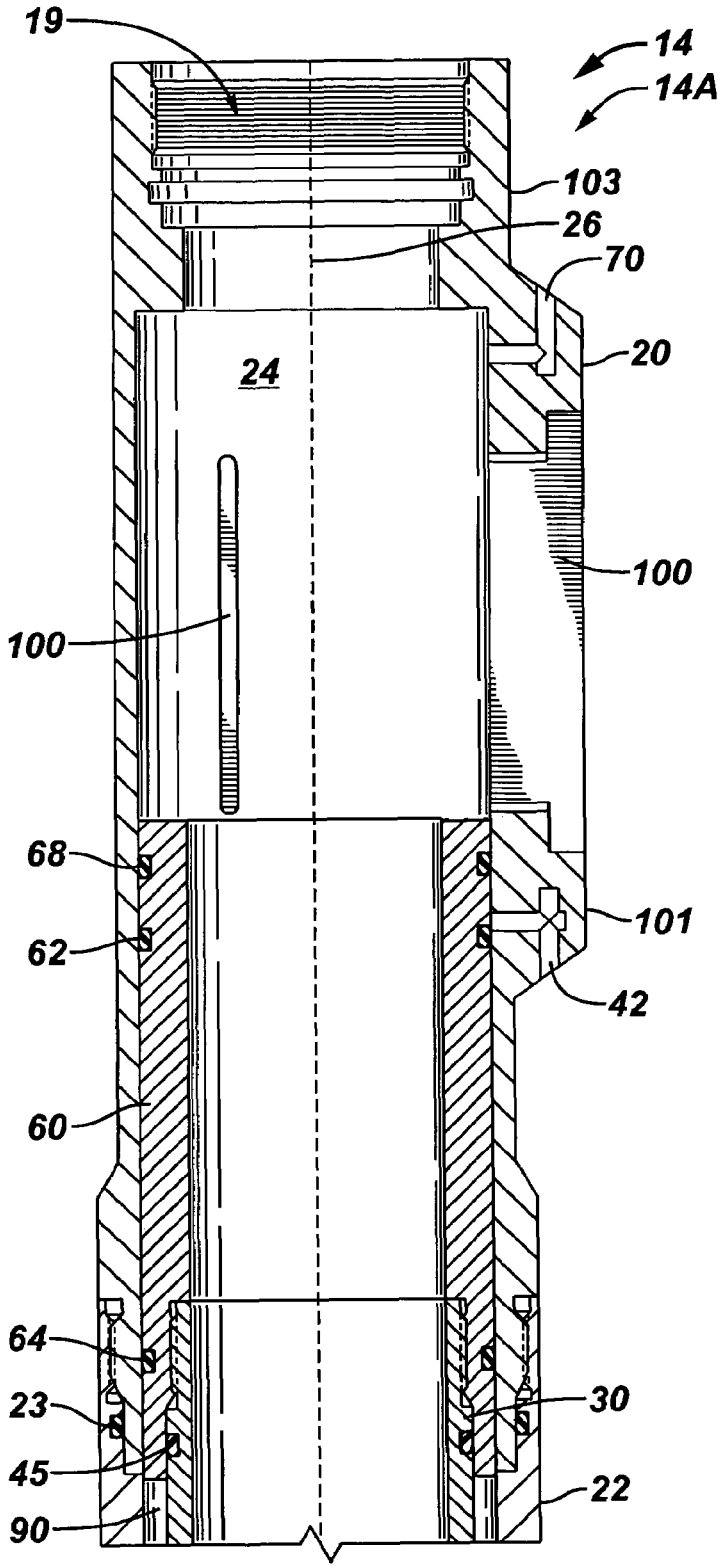
FIGS. 5 and 6 depict the valve in its open state according to an embodiment of the invention.
Figure 6:
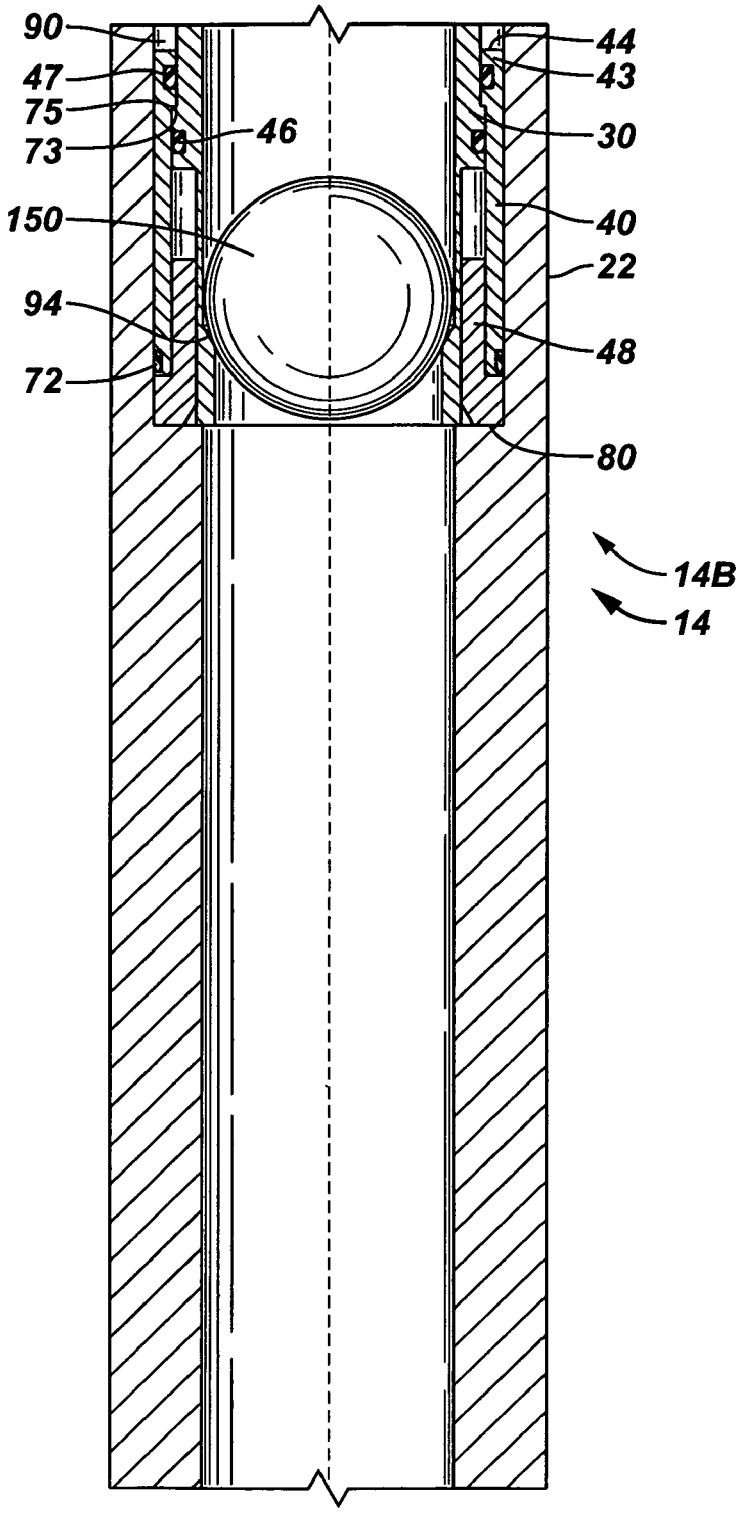

Thus, to open the valve 14, a ball is dropped from the surface of the well, and then a sufficient pressure is applied (aided by the restriction presented by the lodged ball) to cause the valve sleeve 60 to shift from its uppermost position to its lowest position, a position that is depicted in FIGS. 5 and 6. More particularly, FIGS. 5 and 6 depict the valve 14 in its open state. As shown in FIG. 5, in the open state, one or more radial ports 100 formed in the upper housing section 20 are exposed to the central passageway 24 of the valve 14. Thus, in the open state, fluid, such as fracturing fluid (for example), may be communicated from the central passageway 24 of the string (see FIG. 1) to the annular region that surrounds the valve 14. It is noted that when the valve 14 is closed, the radial openings 100 are sealed off between the upper 62 and lower 64 O-rings.

Referring to FIG. 6, due to the pressure that is exerted on the valve sleeve 60, the assembly that is formed from the valve sleeve 60, collet sleeve 30, mandrel 40 and sleeve 48 travels downwardly until the bottom surface of the collet sleeve 30 and the bottom surface of the sleeve 48 reside on an annular shoulder that is formed at the bottom of the annular pocket 80. FIG. 6 also depicts a sphere, or ball 150, that rests on the seat 94 and has caused the valve 14 to transition to its open state.

Referring back to FIG. 5, in the open state of the valve 14, the passageway 70 is in fluid communication with the central passageway 24. This is in contrast to the closed state of the valve in which the O-ring 68 forms a seal between the central passageway 24 and the passageway 70, as depicted in FIGS. 2 and 4. Therefore, in the valve's open state, fluid pressure may be communicated to the passageway 70 (see FIG. 5) for purposes of transitioning another valve 14 of the string 12 (see FIG. 1) to its ball catching state.

As a more specific example, in some embodiments of the invention, the passageway 70 may be in fluid communication with the passageway 42 of another valve 14 (the immediately adjacent valve 14 above, for example). Therefore, in response to the valve sleeve 60 moving to its lower position, a downward force is applied (through the communication of pressure through the passageways 70 and 42) to the mandrel 40 of another valve 14 of the string 12. As a more specific example, in some embodiments of the invention, the passageway 70 of each valve 14 may be in fluid communication with the passageway 42 of the immediate upper adjacent valve in the string 12. Thus, referring to FIG. 1, for example, the passageway 70 of the valve 143 is connected to the passageway 42 of the valve $\mathbf{14}_2$, and the passageway 70 of the valve $\mathbf{14}_2$ is connected to the passageway 42 of the valve $\mathbf{14}_1$. It is noted that the valve $\mathbf{14}_1$ in the exemplary embodiment that is depicted in FIG. 1, is the uppermost valve 14 in the string 12. Thus, in some embodiments of the invention, the passageway 70 of the valve $\mathbf{14}_1$ may be sealed off or non-existent.

For the lowermost valve $\mathbf{14}_N$, the passageway 42 is not connected to the passageway of a lower valve. Thus, in some embodiments of the invention, the lowermost valve $\mathbf{14}_N$ is placed in its ball catching state using a mechanism that is different from that described above. For example, in some embodiments of the invention, the valve $\mathbf{14}_N$ may be placed in its ball catching state in response to a fluid stimulus that is communicated downhole through the central passageway of the string 12. Thus, the lowermost valve $\mathbf{14}_N$ may include a mechanism such as a rupture disc that responds to a remotely-communicated stimulus to permit a downward force to be applied to the mandrel 40.

As another example, in some embodiments of the invention, the above-described actuator may move the mandrel 40 in a downward direction in response to a downhole stimulus that is communicated via a slickline or a wireline that are run downhole through the central passageway of the string 12. As yet another example, the stimulus may be encoded in an acoustic wave that is communicated through the string 12.

As another example of a technique to place the valve $\mathbf{14}_N$ in its ball catching state, in some embodiments of the invention, the mandrel 40 may have a profile on its inner surface for purposes of engaging a shifting tool that is lowered downhole through the central passageway of the string 12 for purposes of moving the mandrel 40 in a downward direction to place the valve $\mathbf{14}_N$ in its ball catching state. As yet another example of yet another variation, in some embodiments of the invention, the valve $\mathbf{14}_N$ may be run downhole with a collet sleeve (replacing the collet sleeve 30) that is already configured to present a ball catching seat. Thus, many variations are possible and are within the scope of the claimed invention.

Because the valve $\mathbf{14}_N$ is the last the valve in the string 12, other challenges may arise in operating the valve $\mathbf{14}_N$. For example, below the lowest layer $\mathbf{15}_N$, there is likely to be a closed chamber in the well. If a ball were dropped on the seat 94 (see FIG. 14, for example), the valve sleeve 60 of the valve $\mathbf{14}_N$ may not shift downwardly because any movement downward may increase the pressure below the ball. Thus, in some embodiments of the invention, the string 12 includes an atmospheric chamber 17 (see FIG. 1) that is located below the valve $\mathbf{14}_N$. As an example, the chamber 17 may be formed in a side pocket in a wall of the string 12. To initiate the valve $\mathbf{14}_N$ for operation, a perforating gun may be lowered downhole through the central passageway of the string 12 to the position where the atmospheric chamber 17 is located. At least one perforation formed from the firing of the perforating gun may then penetrate the atmospheric chamber 17 to create the lower pressure needed to shift the valve sleeve 60 in a downward direction to open the valve $\mathbf{14}_N$.

In some embodiments of the invention, when the atmospheric chamber 17 is penetrated, a pressure signal is communicated uphole, and this pressure signal may be used to signal the valve $\mathbf{14}_N$ to shift the operator mandrel 40 in a downward direction to place the valve $\mathbf{14}_N$ in the ball catching state. More specifically, in some embodiments of the invention, the valve $\mathbf{14}_N$ may include a pressure sensor that detects the pressure signal so that an actuator of the valve $\mathbf{14}_N$ may respond to the pressure signal to move the mandrel 40 in the downward direction to compress the lower end 32 of the collet sleeve 30.

Alternatively, in some embodiments of the invention, the collet sleeve 30 of the valve $\mathbf{14}_N$ may be pre-configured so that the seat 94 is already in its restricted position when the string 12 is run into the well. A perforating gun may then be lowered through the central passageway of the string 12 for purposes of piercing the atmospheric chamber 17 to allow downward future movement of the sleeve valve 60, as described above.

Figure 7:
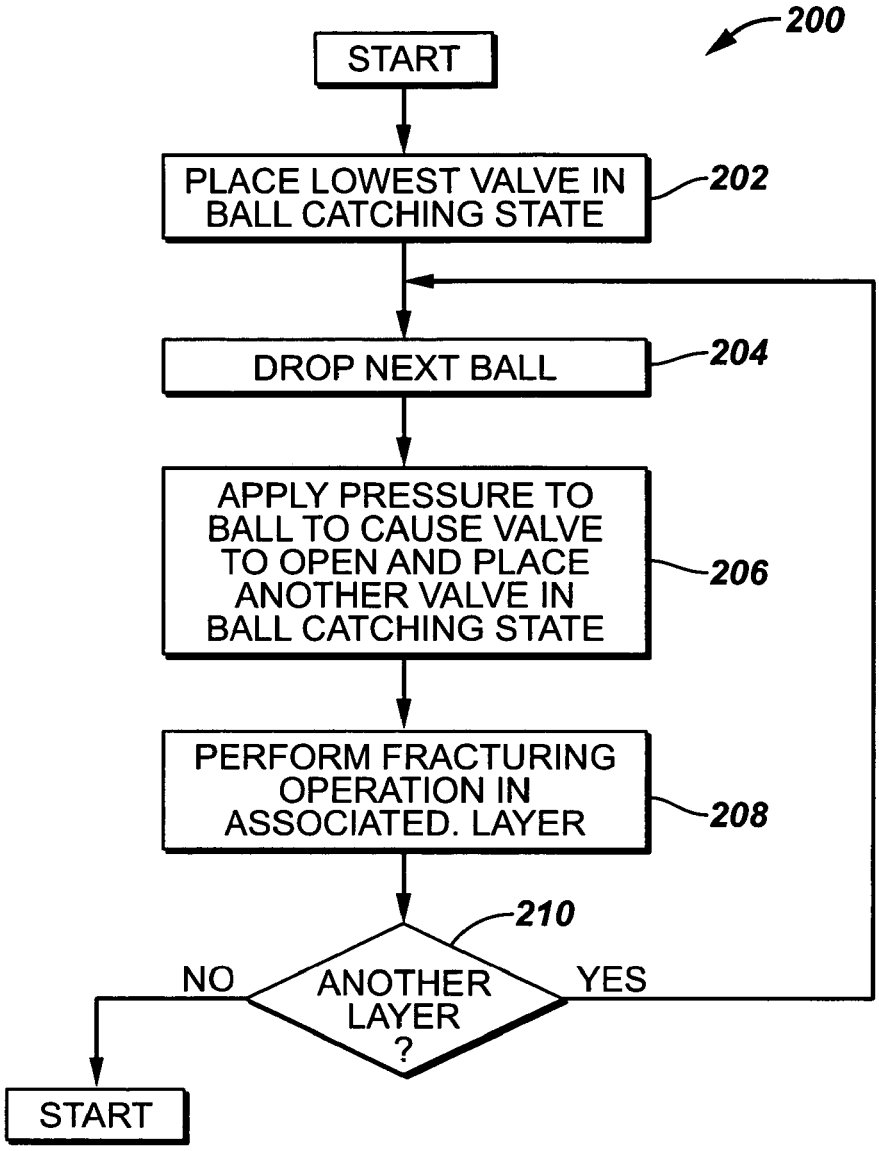
FIG. 7 is a flow diagram depicting a technique to fracture layers in a multiple layer well according to an embodiment of the invention.

Referring to FIG. 7, in some embodiments of the invention, a technique 200 may be used for purposes of fracturing multiple layers of a subterranean well. The technique 200 is used in conjunction with a string that includes valves similar to the ones that are described above, such as the string 12 that contains the valves 14 (see FIG. 1).

Pursuant to the technique 200, the lowest valve of the string is placed in its ball catching state, as depicted in block 202. Next, the technique 200 begins an iteration in which the valves are opened pursuant to a sequence (a bottom-to-top sequence, for example). In each iteration, the technique 200 includes dropping the next ball into the string 12, as depicted in block 204. Next, pressure is applied (block 206) to the ball to cause the valve to open and place another valve (if another valve is to opened) in the ball catching state. Subsequently, the technique 200 includes performing (block 208) fracturing in the layer that is associated with the opened valve. If another layer is to be fractured (diamond 210), then the technique 200 includes returning to block 204 to perform another iteration.

As a more specific example, in some embodiments of the invention, the lowest valve $\mathbf{15}_N$ (see FIG. 1) may be open via a rupture disc and an atmospheric chamber. More specifically, the string 12 is pressured up, the rupture disc breaks and then fluid pushes on side of a piston. The other side of this piston is in contact with an atmospheric chamber or a vacuum chamber.

Contrary to conventional strings that use ball catching valves, the valves 14 are not closed once opened, in some embodiments of the invention. Furthermore, in some embodiments of the invention, each valve 14 remains in its ball catching state once placed in this state. Because the valves 14 are designed to trap a ball of the same size, the cross-sectional flow area through the central passageway of the string is not significantly impeded for subsequent fracturing or production operations.

It is noted that for an arbitrary valve 14 in the string 12, once the valve 14 is placed in its ball catching state, the restricted diameter formed from the lower end of the collet sleeve 30 prevents a ball from below the collet sleeve 30 below from flowing upstream. Therefore, during flowback, each ball may be prevented from flowing past the lower end 32 of the collet sleeve 30 of the valve 14 above.

However, in accordance with some embodiments of the invention, each ball may be formed from a material, such as a dissolvable or frangible material, that allows the ball to disintegrate. Thus, although a particular ball may flow upstream during flowback and contact the bottom end of the collet sleeve 30 above, the ball is eventually eroded or at least sufficiently dissolved to flow upstream through the valve to open up communication through the string 12.

In some embodiments of the invention, captured ball used to actuate a lower valve 14 may push up on the collet sleeve 30 of a higher valve in the string 12 until the collet sleeve 30 moves into an area (a recessed region formed in the lower housing 22, for example) which has a pocket in the inner diameter to allow the collet sleeve 30 to reopen. Thus, when the collet sleeve 30 reopens, the inner diameter is no longer small enough to restrict the ball so that the ball can flow uphole. Other variations are possible and are within the scope of the appended claims.

Figure 8:
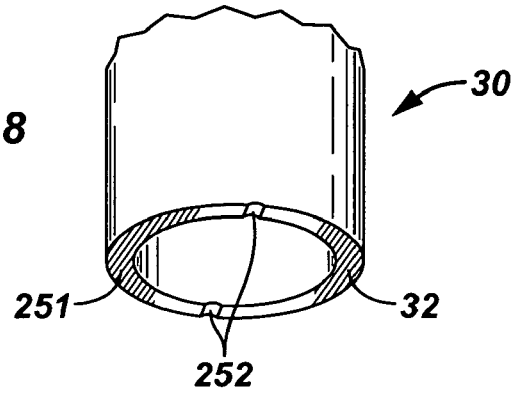
FIG. 8 is a perspective view illustrating surface features on a bottom end of a collet sleeve of the valve according to an embodiment of the invention.

Referring to FIG. 8, in accordance with some embodiments of the invention, a bottom surface 251 of the lower end 32 of the collet sleeve 30 is designed to be irregular to prevent a ball that is located below the collet sleeve 30 (and has not dissolved or eroded enough to pass through) from forming a seal that blocks off fluid communication. Thus, as depicted in FIG. 8, in some embodiments of the invention, the surface 251 may have one or more irregularities, such as a depression 251 that permits the surface 32 from becoming an effective valve seat. Other types of irregularities may be introduced to the surface 251, such as raised portions, generally rough surfaces, etc., depending the particular embodiment of the invention.

Figure 9:
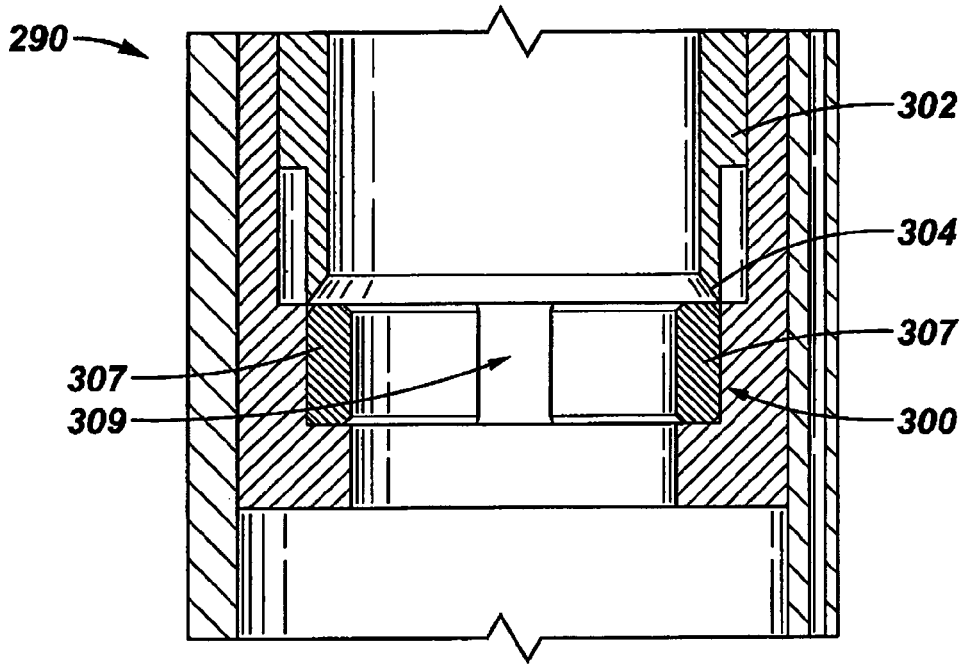
FIGS. 9 and 10 depict different states of a valve that uses a C-ring as a ball catcher in accordance with an embodiment of the invention.
Figure 10:
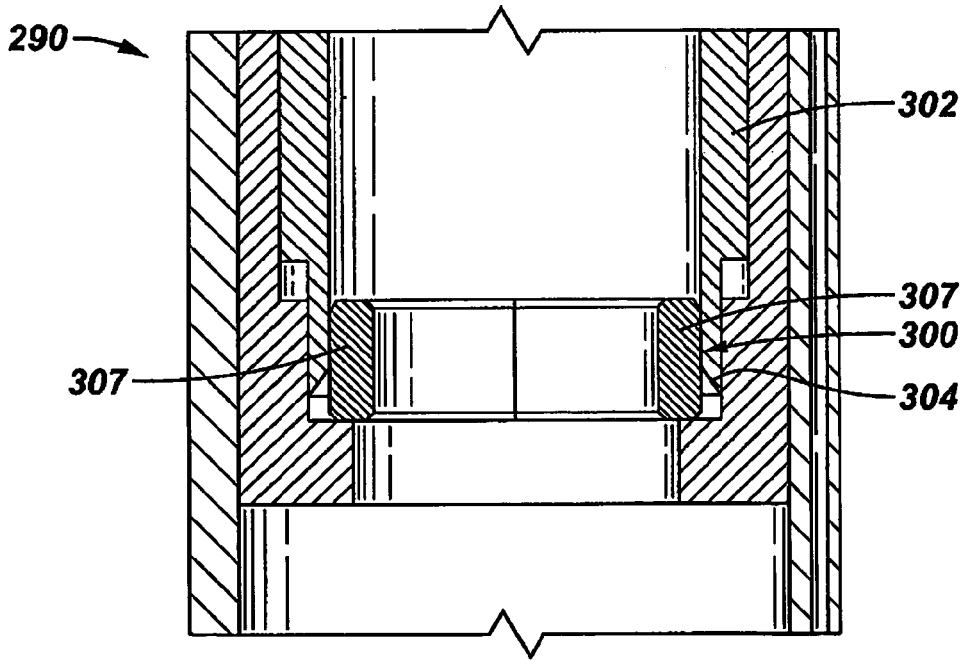

Other embodiments are within the scope of the appended claims. For example, referring to FIG. 9, in some embodiments of the invention, in a valve 290 (that replaces the valve 14) the collet sleeve 30 may be replaced by a C-ring 300. The valve 290 has the same generally design of the valve 14, except for the C-ring 300 and the following differences. The C-ring 300, in some embodiments of the invention, includes a single open slot 309 when the valve is not in the ball catching state. Thus, as depicted in FIG. 9, in this state, a mandrel 302 is located above the C-ring 300 so that the open ends 307 of the C-ring 300 do not compress to close the slot 309. As depicted in FIG. 9, an end 304 of the mandrel 302 may be inclined, or beveled, in some embodiments of the invention so that when the mandrel 302 slides downhole, as depicted in FIG. 10, the ends 307 meet to close the slot 309 (FIG. 9) and thus restrict the inner diameter through the C-ring 300. In the state that is depicted in FIG. 10, the valve is in a ball catching state, as the inner diameter has been restricted for purposes of catching a free-falling or pumped down object.

The C-ring design may be advantageous, in some embodiments of the invention, in that the C-ring 300 includes a single slot 309, as compared to the multiple slots 34 (see FIG. 2, for example) that are present in the collet sleeve 30. Therefore, the C-ring design may be advantageous in that sealing is easier because less leakage occurs when the C-ring ring 300 contracts.

Referring to back to FIG. 1, in some embodiments of the invention, the string 12 may be deployed in a wellbore (e.g., an open or uncased hole) as a temporary completion. In such embodiments, sealing mechanisms may be employed between each valve and within the annulus defined by the tubular string and the wellbore to isolate the formation zones being treated with a treatment fluid. However, in other embodiments of the invention, the string 12 may be cemented in place as a permanent completion. In such embodiments, the cement serves to isolate each formation zone.

The cementing of the string 12 may potentially block valve openings, if not for certain features of the valve 14. For example, referring back to FIG. 5, in some embodiments of the invention, the valve 14 may include lobes 101 that are spaced around the longitudinal axis 26. Each lobe 101 extends radially outwardly from a main cylindrical wall 103 of the upper housing 20, and each radial port 100 extends through one of the lobes 101. The lobes 101 restrict the space otherwise present between the valve 14 and the wellbore to limit the amount of cement that may potentially block fluid communication between the central passageway 24 and the region outside of the valve 14, as described in co-pending U.S. patent application Ser. No. 10/905,073 entitled, "SYSTEM FOR COMPLETING MUTLIPLE WELL INTERVALS," filed on Dec. 14, 2004.

In accordance with some embodiments of the invention, each radial port 100 is formed from an elongated slot whose length is approximately equal to at least five times its width. It has been discovered that such a slot geometry when used in a fracturing operating allows radial deflection when pressuring up, which increases stress in the rock and thus, reduces the fracturing initiation pressure.

Depending on the particular embodiment of the invention, the valve may contain, as examples, three (spaced apart by 120° around the longitudinal axis 26, for example) or six (spaced apart by 60° around the longitudinal axis 26, for example) lobes 101. In some embodiments of the invention, the valve 14 does not contain the lobes 101. Instead, the upper housing section 20 approximates a circular cylinder, with the outer diameter of the cylinder being sized to closely match the inner diameter of the wellbore.

Other variations are possible in accordance with the various embodiments of the invention. For example, depending on the particular embodiment of the invention, each radial port 100 may have a length that is at least approximately equal to ten or (in other embodiments) is approximately equal to twenty times its length.

Figure 11:
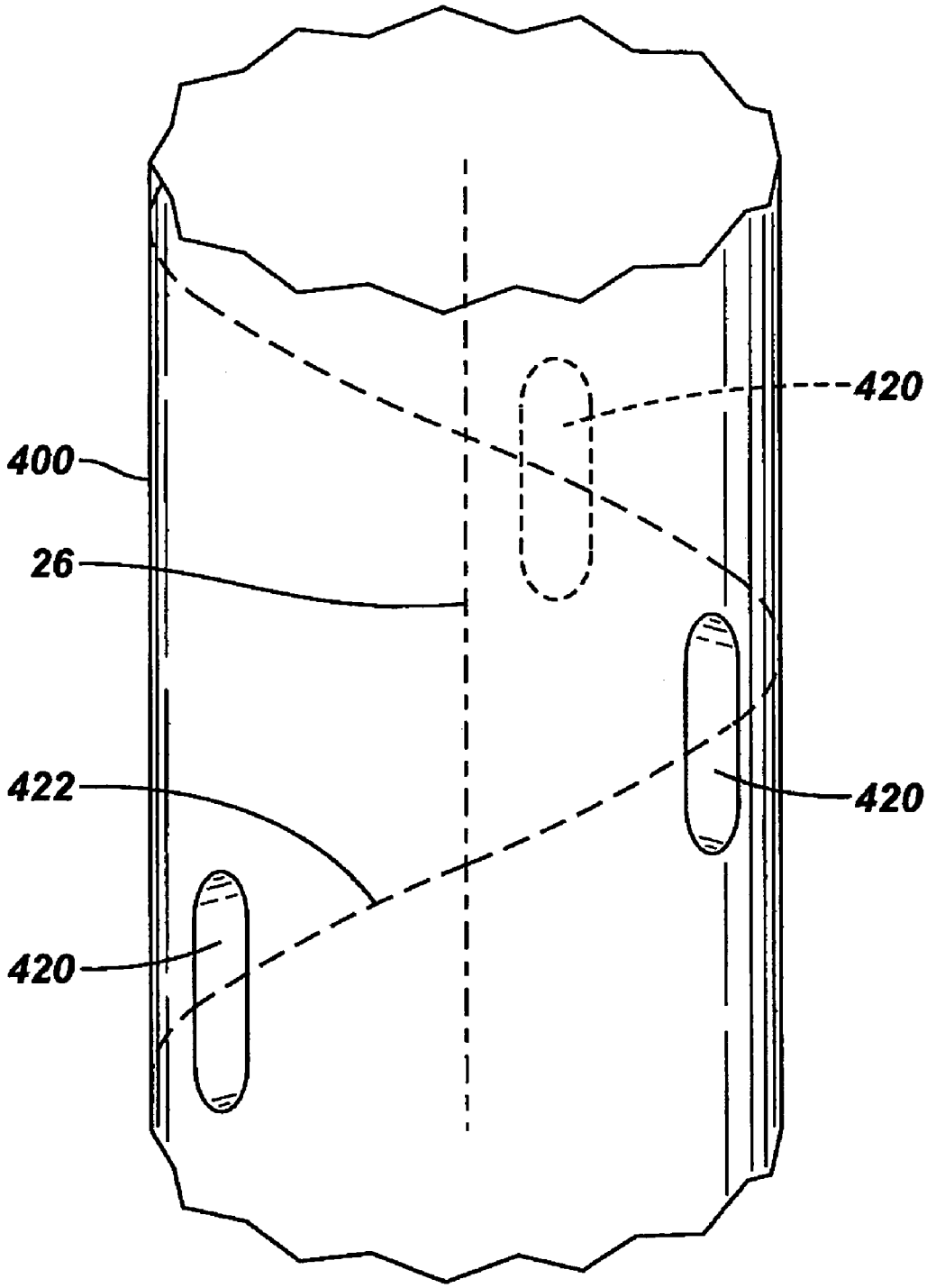
FIG. 11 is a perspective view of a valve housing according to another embodiment of the invention.

The radial slots 100 are depicted in FIG. 5 as being located at generally the same longitudinal position. However, in other embodiments of the invention, a valve (FIG. 11) may include a valve housing 400 (replacing the upper valve housing 20) that includes radial slots 420 that extending along a helical, or spiral path 422, about the longitudinal axis 26. As shown in FIG. 11, the valve housing 400 does not contain the radially-extending lobes. Thus, many variations are possible and are within the scope of the appended claims.

Although directional and orientational terms (such as "upward," "lower," etc.) are used herein to describe the string, the valve, their components and their operations, it is understood that the specific orientations and directions that are described herein are not needed to practice the invention. For example, in some embodiments of the invention, the valve sleeve may move in an upward direction to open. As another example, in some embodiments of the invention, the string may be located in a lateral wellbore. Thus, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

a string comprising a passageway; and a plurality of tools mounted in the string and being adapted to be placed in a state to catch objects of substantially the same size communicated downhole through the passageway, wherein each of said plurality of tools, when placed in the state, restricts its inner diameter from a larger size to a size smaller than said same size to catch one of the objects.

2. The apparatus of claim 1, wherein the sizes of the objects vary less than approximately 0.125 inches.

3. The apparatus of claim 1, wherein the objects comprise at least one of a free-falling object and a pumped down object.

4. The apparatus of claim 1, wherein only one of the plurality of tools is placed in the state at any one time.

5. The apparatus of claim 1, wherein each of said plurality of tools, when placed in the state, restricts its inner diameter to the same size to catch the object.

6. The apparatus of claim 1, wherein the plurality of tools are adapted to be placed in the states according to a sequence.

7. The apparatus of claim 6, wherein the sequence is based on a position of the tool in the string.

8. The apparatus of claim 6, wherein the sequence comprises a sequence in which the tools are placed in the state with each lower tool occurring in the sequence before an upper tool.

9. The apparatus of claim 1, wherein each of the plurality of tools is adapted to place another one of the tools in the state in response to said each tool performing a downhole function.

10. The apparatus of claim 1, wherein the plurality of tools comprises valves.

11. The apparatus of claim 1, wherein at least one of the tools is adapted to restrict a flow passageway through the tool in response to the tool catching one of the objects and use the restriction of the flow to activate the tool.

12. The apparatus of claim 11, wherein said at least one of the tools comprises a valve comprising a sleeve adapted to respond to a force communicated through the restricted flow to open the valve.

13. The apparatus of claim 12, wherein the valve further comprises a port adapted to communicate pressure to place another one of the tools in the state in response to the opening of the valve.

14. An apparatus usable with a well, comprising:

a tubular member comprising a passageway;

a first tool attached to the tubular member, the first tool adapted to be placed in a state to catch a first object communicated through the passageway and perform an operation after catching the first object; and a second tool attached to the tubular member and adapted to transition to a state to catch a second object communicated through the passageway in response to the operation, wherein the first object is communicated through a passageway of the second tool.

15. The apparatus of claim 14, wherein the first object and the second object comprise spheres of the same size.

16. The apparatus of claim 14, wherein the at least one of the first tool and the second tool comprises a valve.

17. The apparatus of claim 14, wherein the first tool comprises a valve comprising a sleeve operable to open and close the valve, wherein the sleeve opens to perform the operation and the opening of the sleeve establishes a fluid communication path to cause the second tool to transition to the state to catch the second object.

18. The apparatus of claim 14, wherein the first tool comprises:

a sleeve adapted to form a seat to catch the first object to place the first tool in the state.

19. The apparatus of claim 14, wherein the second tool comprises:

a sleeve adapted to form a seat to catch the first object to place the second tool in the state.

20. The apparatus of claim 14, wherein the second tool comprises a surface to be contacted by the first object after the second tool transitions to the state to catch the second object, the surface being adapted to prevent a seal from forming between the first object and the surface.

21. A method usable with a well, comprising:

providing a string having a plurality of tools and a passageway extending through the tools; and without running an activation tool into the passageway, selectively activating the tools of the string according to a sequence to cause each activated tool to transition from a first state in which the activated tool is configured to allow a free-falling object to pass through the passageway to a second state in which the activated tool is configured to catch the free-falling object.

22. The method of claim 21, wherein the sequence is based on a position of the tool in the string.

23. The method of claim 21, wherein the act of activating comprises:

activating lower tools of the string before activating upper tools of the string.

24. The method of claim 21, wherein the act of activating occurs in response to one of the tools of the string performing a downhole function.

25. The method of claim 21, wherein the plurality of tools comprises valves.

26. A method usable with a well, comprising:

dropping a first object into a passageway of a string;

catching the first object downhole in a first tool and allowing the first object to pass through a second tool;

after the catching, exerting pressure in the passageway to cause the first tool to perform an operation, the operation producing a pressure change downhole; and responding to the pressure change to transition the second tool from a first state in which the second tool is configured to permit a second object communicated through the string to pass through the second tool into a second state in which the second tool is configured to catch the second object.

27. The method of claim 26, wherein the first object and the second object comprise spheres of the same size.

28. The method of claim 26, wherein at least one of the first tool and the second tool comprises a valve.

29. The method of claim 26, wherein the first tool comprises a valve, the method further comprising:

opening the valve to produce the pressure change.

30. The method of claim 26, wherein the act of responding comprises:

compressing a sleeve of the second valve to form a seat to catch the second object.

31. The method of claim 26, further comprising:

flowing the first object upstream to cause the second tool to transition the second tool from the second state to the first state.

32. The method of claim 26, wherein the flowing comprises:

using the first object to contact a radially compressed mechanism of the second tool to force the mechanism into an annular region in which the mechanism radially expands.

33. The method of claim 21, wherein the tools comprise at least one valve and the well contains cement in an annular region between said at least one valve and a formation, the method further comprising:

communicating fluid through said at least one valve to perform at least one of treating and fracturing the formation.

34. The method of claim 21, wherein the tools comprise valves, the method further comprising:

communicating fluid through the valves and surrounding cement to fracture a formation.

35. The method of claim 28, wherein the well contains cement in an annular region between the valve and a formation, the method further comprising:

communicating fluid through the valve to perform at least one of treating and fracturing the formation.

36. The method of claim 26, wherein the first and second tools comprises valves the method further comprising:

communicating fluid through the valves and surrounding cement to fracture a formation.

37. A method usable with a well, comprising:

providing a string comprising a passageway and a plurality of tools; and adapting the tools to catch objects of substantially the same size communicated downhole through the passageway such that each of said plurality of tools, when placed in a state, restricts its inner diameter to the same size from a larger size to catch the object.

38. The method of claim 37, wherein the sizes of the objects vary less than approximately 0.125 inches.

39. The method of claim 37, wherein the objects comprise at least one of a free-falling object and a pumped down object.

40. The apparatus of claim 37, wherein the plurality of tools are adapted to be placed in the states according to a sequence.

* * * * *